US007950102B2

(12) United States Patent
Lee et al.

(10) Patent No.: US 7,950,102 B2
(45) Date of Patent: May 31, 2011

(54) UPRIGHT VACUUM CLEANER HAVING STEERING UNIT

(75) Inventors: Byung-jo Lee, Gwangju (KR); Joung-soo Park, Jeollabuk-do (KR); Tae-gwang Kim, Gwangju (KR); See-hyun Kim, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 583 days.

(21) Appl. No.: 12/075,706

(22) Filed: Mar. 13, 2008

(65) Prior Publication Data

US 2009/0089969 A1 Apr. 9, 2009

(30) Foreign Application Priority Data

Oct. 8, 2007 (KR) ..... 10-2007-0101077

(51) Int. Cl.
*A47L 5/00* (2006.01)
*A47L 5/28* (2006.01)

(52) U.S. Cl. ..... 15/327.4; 15/350; 15/351

(58) Field of Classification Search ..... 15/327.4, 15/350, 351; *A47L 5/00, 5/28*
See application file for complete search history.

(56) References Cited

U.S. PATENT DOCUMENTS

| | | | | |
|---|---|---|---|---|
| 5,323,510 | A | 6/1994 | Redding et al. | 15/411 |
| 2006/0207054 | A1* | 9/2006 | Loebig | 15/351 |

FOREIGN PATENT DOCUMENTS

| | | |
|---|---|---|
| GB | 2391459 | 2/2004 |
| GB | 2433425 | 6/2007 |
| KR | 1020060058293 | 5/2006 |

OTHER PUBLICATIONS

Search and Examination Report dated Oct. 27, 2008 corresponding to United Kingdom Patent Application No. 0812326.7.

* cited by examiner

*Primary Examiner* — David A Redding
(74) *Attorney, Agent, or Firm* — Ohlandt, Greeley, Ruggiero & Perle, LLP

(57) ABSTRACT

An upright vacuum cleaner having a steering unit is provided. The upright vacuum cleaner includes a cleaner body having a suction motor and a dust separating and collecting unit, a suction port assembly rotatably connected to a lower portion of the cleaner body, a handle mounted to the cleaner body, and a steering unit to elastically support the cleaner body so that the center of gravity of the cleaner body shifts to the direction where the cleaner body is rotated, according to the rotation of the cleaner body to the left or right.

14 Claims, 5 Drawing Sheets

UPRIGHT VACUUM CLEANER HAVING STEERING UNIT

CROSS-REFERENCE TO RELATED APPLICATIONS

This application claims the benefit under 35 U.S.C. § 119 (a) of Korean Patent Application No. 10-2007-0101077, filed on Oct. 8, 2007, in the Korean Intellectual Property Office, the entire contents of which are hereby incorporated by reference.

BACKGROUND OF THE INVENTION

1. Field of the Invention

The present disclosure relates to a vacuum cleaner. More particularly, the present disclosure relates to an upright vacuum cleaner which draws in dust-laden air from a surface being cleaned, selectively through a suction port assembly or an extension pipe connected to a cleaner body, using a suction force generated by a motor housed in the cleaner body, and which separates the dust from the drawn air.

2. Description of the Related Art

Vacuum cleaners are generally classified into upright vacuum cleaners and canister vacuum cleaners. An upright vacuum cleaner has a suction port assembly which is directly connected to a cleaner body, without requiring a separate hose of extension pipe, and provides improved cleaning efficiency especially on carpets or upholstery, by using its own weight.

Unlike the upright vacuum cleaner, a canister vacuum cleaner has a suction port assembly connected to a cleaner body through a host and an extension pipe. The canister vacuum cleaner is easier for a user to manipulate than an upright vacuum cleaner, and therefore, the canister vacuum cleaner is generally used to clean narrow places which are not accessible by an upright vacuum cleaner, such as steps, or niches.

An upright vacuum cleaner is generally heavy and thus hard for a user to change the direction of a suction port assembly. Furthermore, since the suction port assembly generally moves in a linear direction, a user of an upright vacuum cleaner has to pull the vacuum cleaner towards him first, in order to move the suction port assembly to an intended location.

An example of a conventional upright vacuum cleaner is described in GB2391459, published on Feb. 11, 2004, by Dyson. The upright vacuum cleaner of GB2391459 includes a suction motor housed in a cleaner body, and a spherical rotatable member to increase maneuverability of the vacuum cleaner.

However, the conventional upright vacuum cleaner has a very complicated structure, and accordingly suffers deteriorated assemblability. Furthermore, a considerable amount of cost and time is required for repair and maintenance.

SUMMARY OF THE INVENTION

An aspect of the present disclosure is to address at least the above problems and/or disadvantages and to provide at least the advantages described below. Accordingly, an aspect of the present disclosure is to provide an upright vacuum cleaner having a steering unit to adjust the direction of a suction port assembly conveniently, according to the movement of a center of gravity to the left or right.

In accordance with an aspect of the present disclosure, an upright vacuum cleaner includes a cleaner body comprising a suction motor and a dust separating and collecting unit, a suction port assembly rotatably connected to a lower portion of the cleaner body, a handle mounted to the cleaner body, and a steering unit to elastically support the cleaner body so that the center of gravity of the cleaner body shifts to the direction where the cleaner body is rotated, according to the rotation of the cleaner body to the left or right.

The steering unit may include a connected housing formed on a lower portion of the cleaner body, a first and second supports formed in such a manner that one end of the first support and one end of the second support are rotatably formed on both sides of the connected housing and the other end of the first support and the other end of the second support are rotatably connected to a first and second main wheels, a shaft to connect the one end of the first support and the one end of the second support, and a first elastic member disposed between the first support and one end of the shaft, and a second elastic member disposed between the second support and the other end of the shaft. One of the first and second supports that is closer to a direction where the cleaner body is rotated, is rotated with a winder angle than the other.

The first and second elastic members are rubber springs.

A rear portion of the suction port assembly is rotatably connected to the connected housing.

The handle is arranged at a right angle with respect to a width direction of the suction port assembly.

BRIEF DESCRIPTION OF THE DRAWING FIGURES

The above and other objects, features, and advantages of certain exemplary embodiments of the present disclosure will be more apparent from the following description taken in conjunction with the accompanying drawings, in which.

Throughout the drawings, the same reference numerals will be understood to refer to the same elements, features, and structures.

DETAILED DESCRIPTION OF THE EXEMPLARY EMBODIMENTS

Hereinafter, a vacuum cleaner for use in both an upright form and a canister form according to exemplary embodiments of the present disclosure will be described in detail with reference to the accompanying drawing figures.

Figure 1:
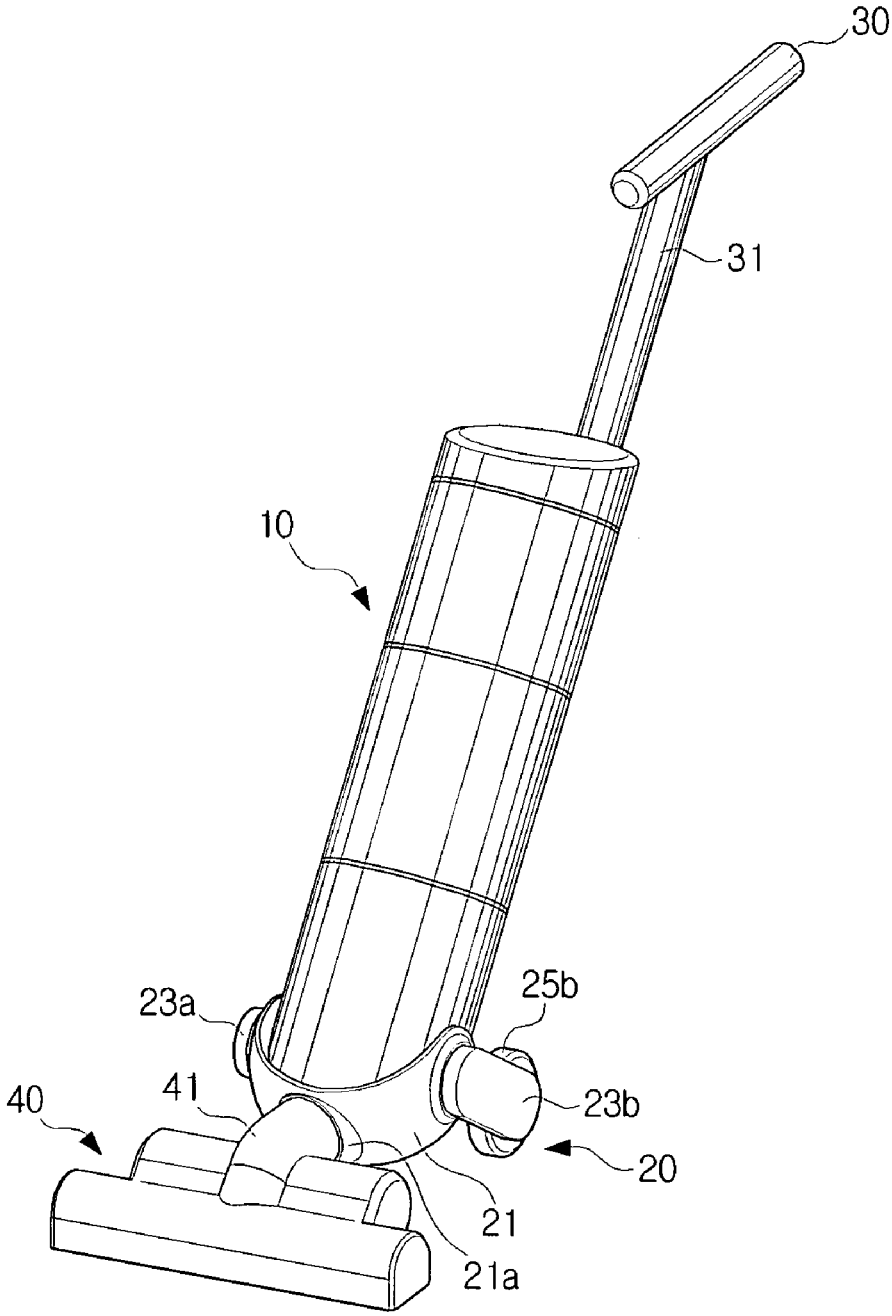
FIG. 1 is a perspective view of an upright vacuum cleaner having a steering unit according to an exemplary embodiment of the present disclosure.
Figure 2:
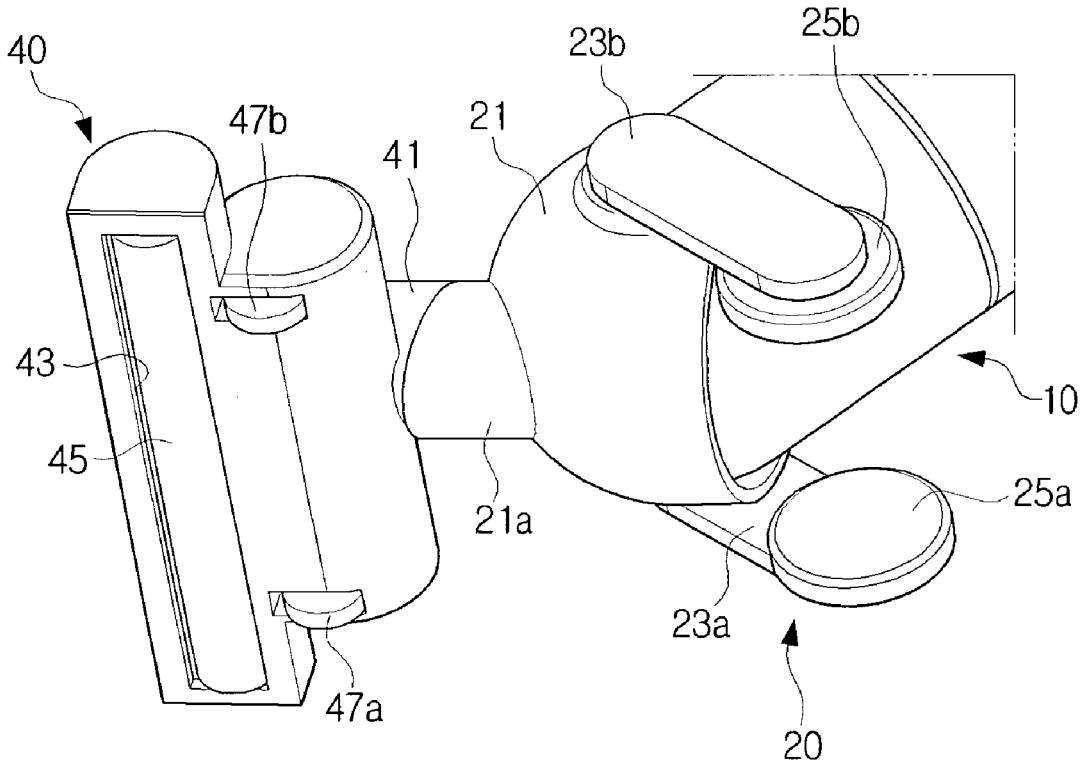
FIG. 2 is a perspective view illustrating the lower portion of the upright vacuum cleaner of FIG. 1.
Figure 3:
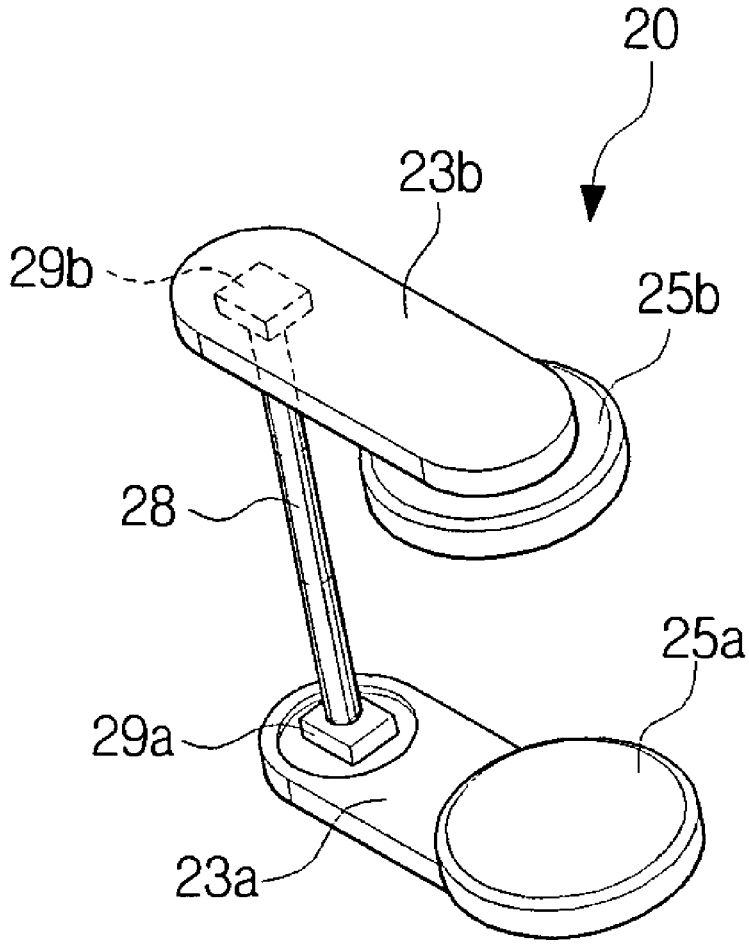
FIG. 3 is a perspective view of a steering unit of FIG. 2.

Referring to FIGS. 1 to 3, an upright vacuum cleaner includes a cleaner body 10, a steering unit 20, a handle 30, and a suction port assembly 40.

The cleaner body 10 houses therein a suction motor (not shown) as a suction source, and also houses a dust separating and collecting unit (not shown) which has a dust collecting receptacle (not shown) and a dust separating part (not shown).

The dust separating part (not shown) separates dust from the air drawn by the suction force of a suction motor (not shown) so that the separated dust is collected in the dust collecting receptacle (not shown) disposed therebelow. A cyclone structure may desirably be implemented to separate dust from air by using a centrifugal force. However, this should not be construed as limiting. For example, a dust bag (not shown) may be implemented to filter dust instead of the cyclone structure.

The steering unit 20 includes a connected housing 21, a first support 23*a*, a second support 23*b*, a first main wheel 25*a*, a second main wheel 25*b*, a shaft 28, a first elastic member 29*a*, and a second elastic member 29*b*.

The connected housing 21 is fixed to the lower portion of the cleaner body 10, and includes a connection port 21*a* to which a guiding pipe 41 of a suction port assembly 40 is rotatably inserted.

One end of the first support 23*a* and one end of the second support 23*b* are rotatably connected to both sides of the connected housing. The other end of the first support 23*a* and the other end of the second support 23*b* are rotatably connected to the first and second main wheels 25*a* and 25*b*, respectively. The first and second supports 23*a* and 23*b* are connected with each other by the shaft 28, which passes through the lower portion of the cleaner body.

The first elastic member 29*a* may be disposed between the first support 23*a* and one end of the shaft 28. The second elastic member 29*b* may be disposed between the second support 23*b* and the opposite end of the shaft 28. The first and second elastic members 29*a* and 29*b* may desirably be implemented as rubber springs. Accordingly, the first and second elastic members 29*a* and 29*b* deform between the first and second supports 23*a* and 23*b* and the shaft 28 as the center of gravity of the cleaner body 10 moves to the right or left, and return to original form by their recovery forces as the center of the gravity of the cleaner body 10 moves back to the original center position.

The handle 30 may be connected to the cleaner body 10 through a predetermined length of extension stick 31. The handle 30 may be implemented as a predetermined length of a bar, and may be arranged at a right angle to the width direction of the suction port assembly 40 to enable a user to grab the handle 30 with one hand and move the center of gravity of the cleaner body 10 to the left or right with ease.

The suction port assembly 40 includes a suction port 43 formed on a lower portion to draw in dust and air from a surface being cleaned. A drum brush 45 may be rotatably disposed within the suction port assembly 43. The guiding pipe 41, which is connected with the suction port 43, extends from a rear side of the suction port assembly 40. A flexible hose (not shown) may desirably be disposed inside the guiding pipe 41 to deliver the dust and air drawn through the guiding pipe 41 towards the dust separating and collecting unit of the cleaner body 10. This prevents the loss of suction force between the guiding pipe 41 and the connection port 21*a* by the rotation of the cleaner body 10 about the suction port assembly 40. Protection wheels 47*a* and 47*b* may be provided in suction port assembly 40.

Figure 4:
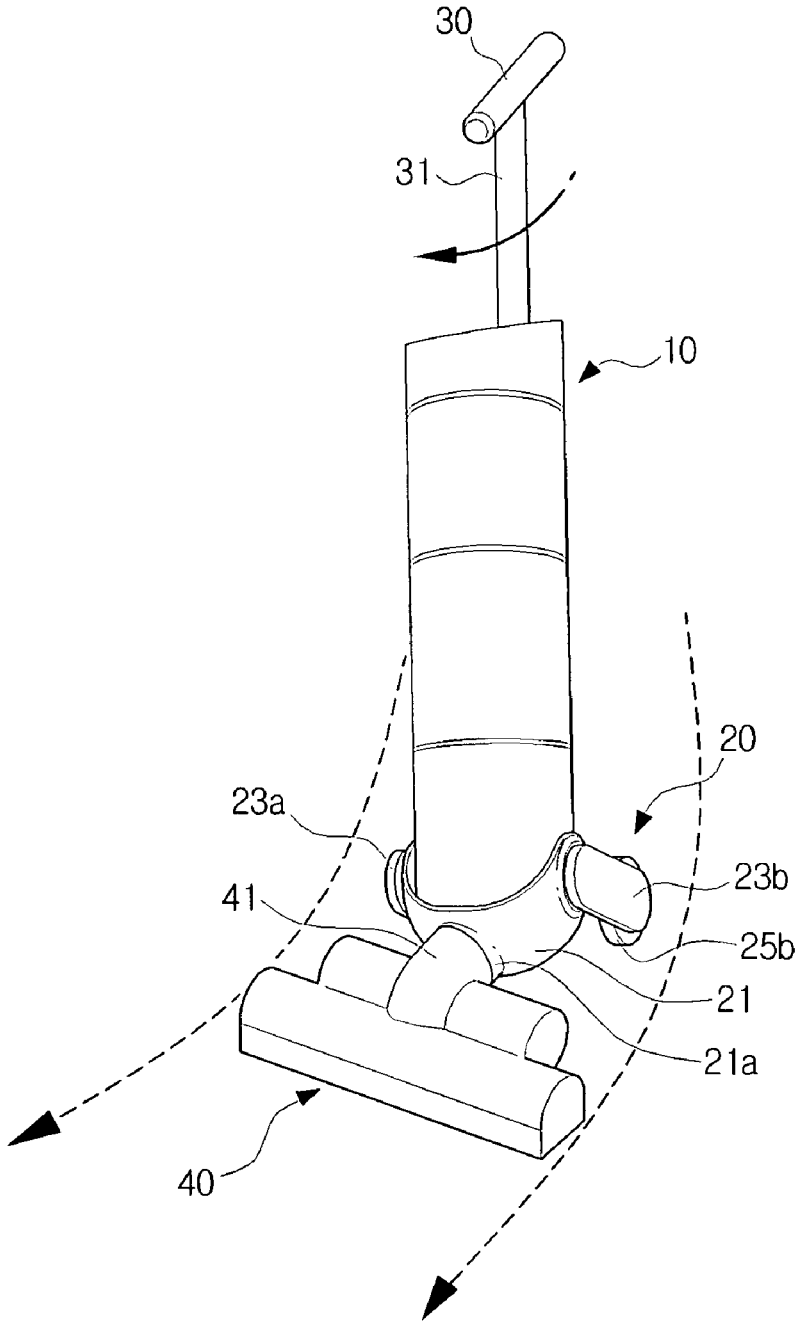
FIG. 4 illustrates an upright vacuum cleaner having a steering unit in operation according to an exemplary embodiment of the present disclosure.
Figure 5:
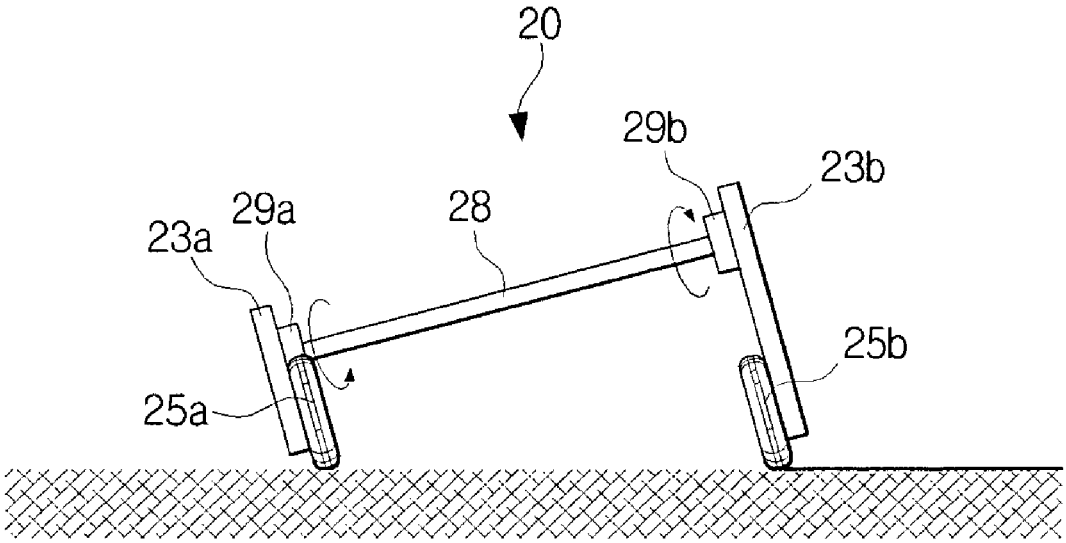
FIG. 5 illustrates the steering unit of the upright vacuum cleaner of FIG. 4 in operation.

The steering operation of the upright vacuum cleaner according to an exemplary embodiment of the present disclosure will be explained below with reference to FIGS. 4 and 5. FIGS. 4 and 5 illustrate an example where the user adjusts the upright vacuum cleaner to the right. Herein, the rotating direction of the cleaner body 10 will be explained as the rightward direction from the user, who is positioned behind handle 30.

Referring to FIG. 4, the user grabs the handle 30 with one hand and rotates it 30 to the right, in order to move the suction port assembly 40 to the right side.

Accordingly, the cleaner body 10 rotates to the rotating direction of the handle 30, and the center of gravity of the cleaner body 10 is shifted to the right.

As a result, the weight of the cleaner body 10 is transmitted to the first elastic member 29*a* via the shaft 28, and the forces are focused on the first elastic member 29*a* which is positioned at a lower longitude than the first support 23*a* and the shaft 28. The first support 23*a*, disposed on the side to which the cleaner body 10 rotates, is rotated to a wider angle than the second support 23*b*, to maintain approximately parallel relation of the suction port assembly 40 to the surface being cleaned (FIG. 5). The connected housing 21, which is connected with the guiding pipe 41 of the suction port assembly 40, is rotated to the right along with the cleaner body 10.

Accordingly, a user can maneuver the suction port assembly 40 conveniently, by simply rotating the handle 30 to the right.

Although omitted herein, one will understand that the suction port assembly 40 may also be moved to the left.

According to the exemplary embodiments of the present disclosure, a steering unit having a first and second elastic members, which are desirably the rubber springs, is provided, to reduce number of assembling parts, increase productivity, and greatly reduce cost for repair and maintenance.

Furthermore, a user of an upright vacuum cleaner can easily move the suction port assembly as he wishes, by simply moving the center of gravity of the cleaner body to the rotating direction of the suction port assembly.

Although representative exemplary embodiment of the present disclosure has been shown and described in order to exemplify the principle of the present disclosure, the present disclosure is not limited to the specific embodiment. It will be understood that various modifications and changes can be made by one skilled in the art without departing from the spirit and scope of the disclosure as defined by the appended claims. Therefore, it shall be considered that such modifications, changes and equivalents thereof are all included within the scope of the present disclosure.

What is claimed is:

1. An upright vacuum cleaner, comprising:

a cleaner body;

a suction port assembly rotatably connected to a lower portion of the cleaner body;

a handle mounted to the cleaner body; and a steering unit to elastically support the cleaner body so that a center of gravity of the cleaner body shifts to a direction where the cleaner body is rotated, according to a rotation of the cleaner body to the left or right, wherein the steering unit comprises:

a connected housing formed on a lower portion of the cleaner body;

a first support and a second support formed in such a manner that one end of the first support and one end of the second support are rotatably formed on opposite sides of the connected housing and the other end of the first support and the other end of the second support are rotatably connected to a first main wheel and a second main wheel, respectively;

a shaft to connect one end of the first support and one end of the second support; and a first elastic member disposed between the first support and one end of the shaft, and a second elastic member disposed between the second support and the other end of the shaft, wherein one of the first and second supports that is closer to a direction where the cleaner body is rotated, is rotated with a winder angle than the other of the first and second supports.

2. The upright vacuum cleaner of claim 1, wherein the first and second elastic members are rubber springs.

3. The upright vacuum cleaner of claim 1, further comprising a rear portion of the suction port assembly being rotatably connected to the connected housing.

4. The upright vacuum cleaner of claim 1, wherein the handle is arranged at a right angle with respect to a width direction of the suction port assembly.

5. The upright vacuum cleaner of claim 1, wherein the suction port assembly further comprises a suction port formed on a lower portion to draw in dust and air from a surface being cleaned.

6. The upright vacuum cleaner of claim 1, further comprising a drum brush rotatably disposed within the suction port assembly.

7. The upright vacuum cleaner of claim 1, further comprising protection wheels in the suction port assembly.

8. An upright vacuum cleaner, comprising:

a suction port assembly having a suction port formed on a lower portion and a guiding pipe in fluid communication with the suction port;

a cleaner body having a handle mounted to a first side of the cleaner body; and a steering unit having a connected housing and a connection port, the connected housing being configured to connect the cleaner body to the steering unit so that the cleaner body is in fluid communication with the connection port, the connection port being rotatably connected to and in fluid communication with the guiding pipe so that the cleaner body is in fluid communication with the suction port, wherein the steering unit comprises a first support having a first main wheel, a second support having a second main wheel, a shaft, a first elastic member, and a second elastic member, the shaft passing through the cleaner body so that the first elastic member connects a first end of the shaft to the first support and the second elastic member connects a second end of the shaft to the second support, the steering unit being configured so that the suction port assembly maintains approximately a parallel relation to a surface being cleaned when a center of gravity of the cleaner body shifts to a direction where the cleaner body is rotated.

9. The upright vacuum cleaner of claim 8, wherein, when the center of gravity of the cleaner body is shifted to the direction proximate the first support, the first support is rotated to a wider angle than the second support and wherein, when the center of gravity of the cleaner body is shifted to the direction proximate the second support, the second support is rotated to a wider angle than the second support.

10. The upright vacuum cleaner of claim 8, wherein the first and second elastic members deform between the first and second supports and the shaft as the center of gravity of the cleaner body moves to the right or left and return to original form by their recovery forces as the center of the gravity of the cleaner body moves back to an original center position.

11. The upright vacuum cleaner of claim 10, wherein the first and second elastic members are rubber springs.

12. The upright vacuum cleaner of claim 8, wherein the handle is arranged at a right angle with respect to a width direction of the suction port assembly.

13. The upright vacuum cleaner of claim 8, further comprising a drum brush rotatably disposed within the suction port assembly.

14. The upright vacuum cleaner of claim 8, further comprising protection wheels in the suction port assembly.

* * * * *